US007874465B2

(12) United States Patent
Bertin et al.

(10) Patent No.: US 7,874,465 B2
(45) Date of Patent: Jan. 25, 2011

(54) FLUID DISPENSER HEAD

(75) Inventors: Romain Bertin, Evreux (FR); Florent Pouliaude, Thuit Signol (FR)

(73) Assignee: Valois S.A.S., Le Neubourg (FR)

( * ) Notice: Subject to any disclaimer, the term of this patent is extended or adjusted under 35 U.S.C. 154(b) by 750 days.

(21) Appl. No.: 11/878,702

(22) Filed: Jul. 26, 2007

(65) Prior Publication Data

US 2008/0023498 A1 Jan. 31, 2008

Related U.S. Application Data

(60) Provisional application No. 60/845,766, filed on Sep. 20, 2006.

(30) Foreign Application Priority Data

Jul. 26, 2006 (FR) ..... 06 53121

(51) Int. Cl.
*B65D 83/00* (2006.01)

(52) U.S. Cl. ..... 222/402.12; 222/153.11; 222/182; 222/320; 222/321.9; 222/402.13

(58) Field of Classification Search ..... 222/402.11, 222/402.12, 402.13, 402.22, 402.23, 402.1, 222/182, 321.9, 320, 153.11, 402.2
See application file for complete search history.

(56) References Cited

U.S. PATENT DOCUMENTS

| | | | | |
|---|---|---|---|---|
| 3,608,785 A | | 9/1971 | Durso et al. | |
| 3,729,119 A | * | 4/1973 | Sette et al. | 222/153.11 |
| 3,729,120 A | * | 4/1973 | Sette et al. | 222/153.12 |
| 3,782,605 A | * | 1/1974 | Messenger | 222/153.11 |
| 3,844,448 A | * | 10/1974 | Sette | 222/153.12 |
| 3,848,778 A | * | 11/1974 | Meshberg | 222/402.11 |

FOREIGN PATENT DOCUMENTS

GB 1 256 001 12/1971

* cited by examiner

*Primary Examiner*—Frederick C. Nicolas
(74) *Attorney, Agent, or Firm*—Sughrue Mion, PLLC

(57) ABSTRACT

A fluid dispenser head for mounting on a fluid reservoir (1), the head having a fluid dispenser member (2), such as a pump or a valve, having a body (20) that is mounted in stationary manner relative to the reservoir (1), and a valve rod (21) that is axially displaceable down and up; a pushbutton (5, 7) that is axially displaceable down and up, driving the valve rod (21); and a dispenser orifice (60) that is connected to the valve rod. The dispenser head has an actuator mechanism (4) for driving the pushbutton in axial displacement relative to the valve rod (21).

16 Claims, 5 Drawing Sheets

FLUID DISPENSER HEAD

CROSS REFERENCE TO RELATED APPLICATION

This application claims the benefit under 35 U.S.C. §119 (e) of U.S. provisional patent application Ser. No. 60/845,766, filed Sep. 20, 2006, and priority under 35 U.S.C. §119 (a)-(d) of French patent application No. FR-06.53121, filed Jul. 26, 2006.

TECHNICAL FIELD

The present invention relates to a fluid dispenser head for associating with, or for mounting on, a fluid reservoir. The term "dispenser head" refers herein to the entire unit for mounting on a reservoir in order to constitute a fluid dispenser. By actuating the head, the fluid is taken from the reservoir and dispensed through a dispenser orifice. Such dispenser heads are frequently used in the fields of perfumery, cosmetics, or even pharmacy.

BACKGROUND OF THE INVENTION

In conventional manner, the dispenser head comprises a fluid dispenser member, such as a pump or a valve. The dispenser member generally comprises a body that is mounted in stationary manner relative to the reservoir, and a valve rod that is axially displaceable down and up relative to the body. The dispenser head also comprises a pushbutton that is axially displaceable down and up, driving the valve rod. In order to expel the fluid, the dispenser head also includes a dispenser orifice that is connected to the valve rod. Thus, by pressing on the pushbutton by means of one or more fingers, the valve rod is pushed into the body of the dispenser member, thereby dispensing the fluid from the reservoir, optionally in metered manner.

In such a conventional dispenser head, the only possible displacement of the pushbutton is axial displacement down and up, imparted by the user who presses by means of one or more fingers on a thrust surface formed by the pushbutton. Since the pushbutton is coupled directly to the valve rod, its displacement drives the displacement of the valve rod directly. In other words, the pushbutton and the valve rod are displaced together, simultaneously.

In the prior art, dispenser heads are also known provided with pushbuttons that are displaceable in turning about their displacement axis in order to achieve a locking function for the pushbutton. Thus, the pushbutton can be turned between a locked position in which it cannot be displaced axially, and an actuatable position that is unlocked and in which the user can press on the pushbutton and displace it axially down and up, so as to dispense the fluid. However, the pushbutton always remains coupled directly to the valve rod, such that they are constrained to being axially displaced together, simultaneously.

In the prior art, dispensers are also known including a casing in which both the dispenser head and the reservoir are housed. The casing is provided with actuator means that make it possible to displace the dispenser head and the reservoir inside the casing in order to cause the pushbutton to project from the casing for actuation purposes. Once again, the pushbutton is directly connected or coupled to the valve rod, and they are thus displaced together, simultaneously.

BRIEF SUMMARY OF THE INVENTION

An object of the present invention is to define another kind of dispenser head in which the pushbutton is temporarily or selectively decoupled from the valve rod.

To do this, the present invention provides a fluid dispenser head for mounting on a fluid reservoir, the head comprising: a fluid dispenser member, such as a pump or a valve, comprising a body that is mounted in stationary manner relative to the reservoir, and a valve rod that is axially displaceable down and up; a pushbutton that is axially displaceable down and up, driving the valve rod; and a dispenser orifice that is connected to the valve rod; the dispenser head being characterized in that it further comprises actuator means for driving the pushbutton in axial displacement relative to the valve rod. The pushbutton can thus be displaced independently of the valve rod, in such a manner that the dispenser member can be held stationary relative to the reservoir. Naturally, the actuator means should be understood as being a component element of the dispenser head, to the exclusion of the fingers of the user.

The actuator means advantageously cause the pushbutton to turn, with said pushbutton turning through an angular stroke, and being displaced axially between a low axial position and a high axial position. In a practical embodiment, the dispenser head includes cam means for transforming the turning movement of the pushbutton into axial displacement of the pushbutton relative to the valve rod. In another aspect of the invention, the actuator means turn without any axial displacement relative to the body, the cam means being provided between the pushbutton and an element that is mounted in stationary manner relative to the body. The pushbutton is thus displaced both in turning and in axial translation relative to the valve rod. This combined displacement is of the helical type. The user acts on the actuator means by turning them about their own axis without any axial displacement, thereby driving the pushbutton both in turning and in axial translation.

In a practical embodiment, the dispenser head includes fastener means for fastening the dispenser member on the reservoir, the fastener means comprising a ring that is engaged both with the dispenser member and with the reservoir, and a blocking hoop for blocking the ring on the reservoir, the actuator means being rotatably mounted on the hoop, the cam means being formed between the pushbutton and the hoop. The pushbutton is advantageously housed inside the actuator means, the pushbutton and the actuator means presenting a section of shape that is polygonal, advantageously square. By means of the polygonal shape, the pushbutton is driven directly by the actuator means without any need to provide a special arrangement, as would be necessary with a pushbutton and circularly-cylindrical actuator means. However, such a circularly-cylindrical shape is not excluded from the ambit of the present invention.

In another characteristic of the invention, the dispenser orifice is mounted on the pushbutton, and is connected to the valve rod via a flexible hose. The flexible hose enables the pushbutton to be displaced both in turning and in translation relative to the valve rod. Consequently, the flexible hose is deformed while the pushbutton is being displaced relative to the actuator rod, but, in contrast, remains stationary during the fluid dispensing stage, given that the pushbutton is then coupled directly to the valve rod.

In another aspect of the invention, the dispenser orifice is masked by the actuator means when in the low axial position.

The actuator means can thus serve as a protective sheath for protecting the pushbutton in the low axial position.

In another aspect, the valve rod is provided with a force-transmission member, the pushbutton coming into engagement with said member in the high axial position, and being disengaged from said member in the low axial position. The pushbutton advantageously includes two thrust flanges that become positioned on the member in the high axial position, on either side of the valve rod. Consequently, the pushbutton is completely uncoupled from the valve rod in the low axial position. Actuating the pushbutton in the low axial position would have no effect, since the pushbutton would not drive the valve rod. In contrast, in the high axial position, the pushbutton is coupled to the valve rod via the force-transmission member.

In another characteristic of the invention, the member is guided axially by the hoop. This implies that the force-transmission member is not turned by the pushbutton, but, on the contrary, is prevented from rotating, since the hoop is stationary relative to the body and to the reservoir.

With the dispenser head of the invention, the pushbutton is axially displaceable, driving the valve rod only in the high axial position. In the low axial position, the pushbutton is uncoupled from the valve rod. Each time fluid is dispensed, the user can act on the actuator means so as to return the pushbutton to the low axial position, that can thus define a position for rest, transport, or storage.

A principle of the invention resides in the fact that, during a handling stage that is not the fluid dispensing stage, the pushbutton can be displaced axially independently of the valve rod. The handling stage is prior to or after the dispensing stage. The translation movement of the pushbutton is advantageously combined with the pushbutton being turned simultaneously, which is advantageously made possible by using a flexible hose that connects the valve rod to the dispenser orifice formed in the pushbutton.

BRIEF DESCRIPTION OF THE DRAWINGS

The invention is described more fully below with reference to the accompanying drawings which show an embodiment of the invention by way of non-limiting example.

In the figures.

DETAILED DESCRIPTION OF THE INVENTION

Figure 1:
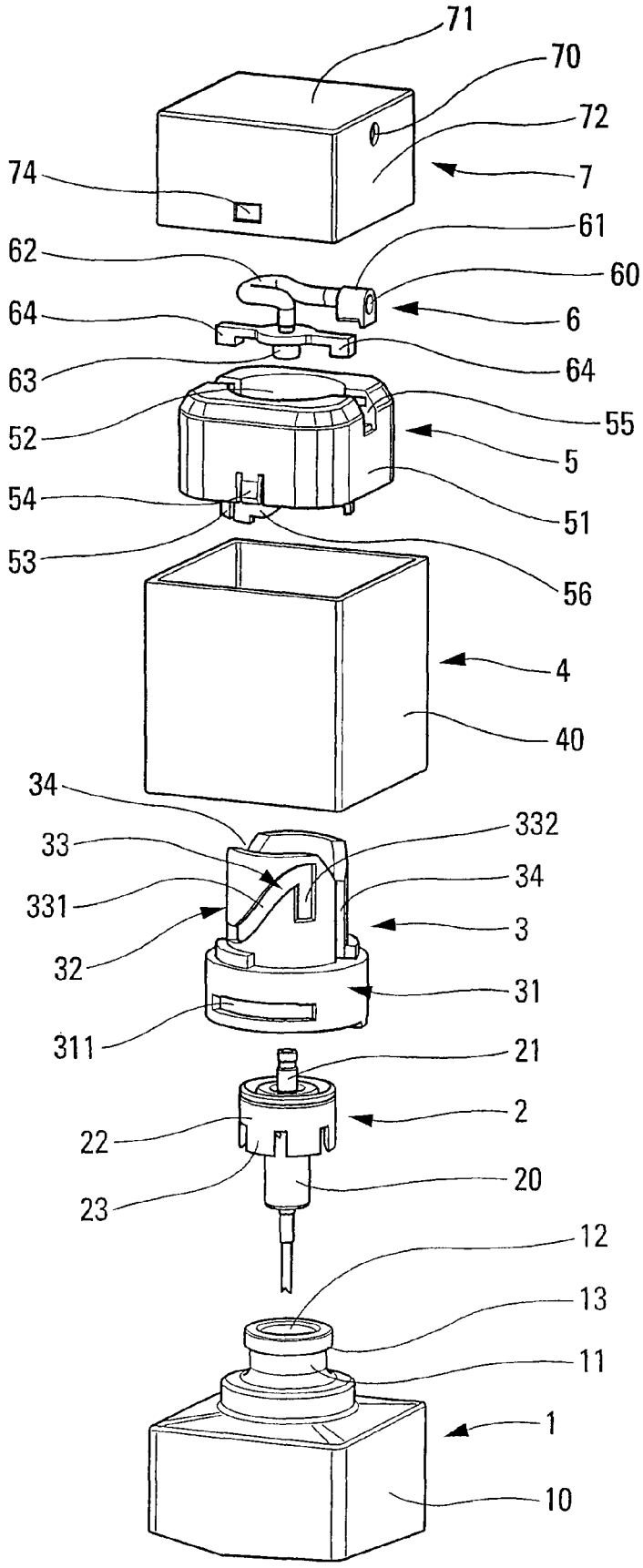
FIG. 1 is an exploded perspective view of a dispenser head of the invention, ready to be mounted on a fluid reservoir.

Reference is made below to FIG. 1 in order to explain in detail the structure of the various component elements of the dispenser head constituting a non-limiting embodiment of the invention.

The dispenser head is for associating with a fluid reservoir 1 that defines a body 10 and a neck 11. The body 10 defines a working volume that is the volume of the reservoir. The neck 11 defines an opening 12 that puts the inside of the body 10 into communication with the outside. The neck 11 forms a projecting outer peripheral rim that defines a shoulder 13 that is oriented downwards. The shoulder 13 serves to fasten the dispenser head on the reservoir. In this particular embodiment, the reservoir defines a section that is polygonal, advantageously square, at the body 10.

In this particular embodiment, the dispenser head comprises six distinct component elements, namely a dispenser member 2, a hoop 3, actuator means 4, a pushbutton core 5, a fluid-flow connection and thrust-transmission system 6, and a pushbutton cover 7. All the component elements can be made by injection-molding an appropriate plastics material. Certain component elements can also be made of metal, such as the actuator means 4 and the pushbutton cover 7, for example.

The dispenser member 2 can be a pump or a valve comprising a body 20 defining a bottom inlet that is optionally provided with a dip tube. The pump or valve also comprises a valve rod 21 that is axially displaceable down and up inside the body 20. In conventional manner, the valve rod 21 defines an internal flow duct for the fluid that is put into communication with the inside of the body 20 selectively by means of an outlet valve. The pump or valve can also be fitted with a fastener ring 22 that is provided with fastener tabs 23 for coming into engagement below the shoulder 13 of the neck 12. In this embodiment, the fastener ring 22 is presented as a component element of the dispenser member. However, the fastener ring can also be in the form of an element that is distinct from the dispenser member, and that is fastened on the dispenser member. However, in this embodiment, the fastener ring is considered as forming an integral part of the dispenser member. This is a fairly conventional design for a pump or a valve in the fields of perfumery, cosmetics, or even pharmacy. By pressing on the valve rod 21, the outlet valve (not shown) opens, and the fluid stored in the body 20 can flow out through the rod 21.

The hoop 3 fulfils a plurality of functions. Its first function is to block or to lock the fastener ring 22 on the neck 11 of the reservoir. To do this, the hoop 3 defines a locking bushing 32 having an inside wall that comes into clamping contact around the ring 22, as can be seen in FIGS. 4, 5, 8, and 9. The hoop 3 thus prevents the tabs 23 of the ring 22 from becoming disengaged from below the shoulder 13. The locking bushing 32 also fulfils other functions. It should be observed in FIG. 1 that the bushing 32 is slotted in such a manner as to define two substantially semi-cylindrical portions that are separated by two axial slots 34. The slots 34 do not extend over the entire height of the locking bushing 32. The bottom portion of the bushing 32 is continuous over its entire periphery, and comes into clamping contact around the tabs 23 at the shoulder 13. The slots 34 are axial guide slots for axially guiding another component element of the head that is described below. In addition, the locking bushing 32 externally defines cam means in the form of two cam paths 33 that form grooves in the outside wall of the bushing 32. Each cam path 33 comprises a helical portion 331 and a vertical axial portion 332. The axial portion 332 is connected to the helical portion 331 at its top end. Each cam path 33 extends substantially over 90°. More precisely, the helical portion 331 extends substantially over 90°, whereas the vertical axial portion 332 is of practically no angular extent. The two cam paths 33 are for co-operating with two cam lugs that are formed by another component element of the head that is described below. It can easily be understood that moving the lugs in the helical portions 331 causes the component element that is described below to move axially. Naturally, this axial displacement is combined with a turning displacement as a result of the helical portion 331 extending over about 90°. In contrast, in the vertical axial portion 332, the cam lug can be displaced vertically and axially, without any turning component. The hoop 3 further defines a base 31 that is for coming around the thicker base of the neck 11. The outside wall of the base 31 forms two elongate grooves 311 that extend substantially over 90°. Each groove is for co-operating with a lug that is free to move inside its respective groove. It can easily be understood that the displacement of the lug has a horizontal turning component only, without any vertical or axial component, because of the horizontal orientation of the groove 311. Each end of the groove 311 defines a stop position in turning. The component element that co-operates with the groove 311 of the hoop 3 is described below.

Figure 2:
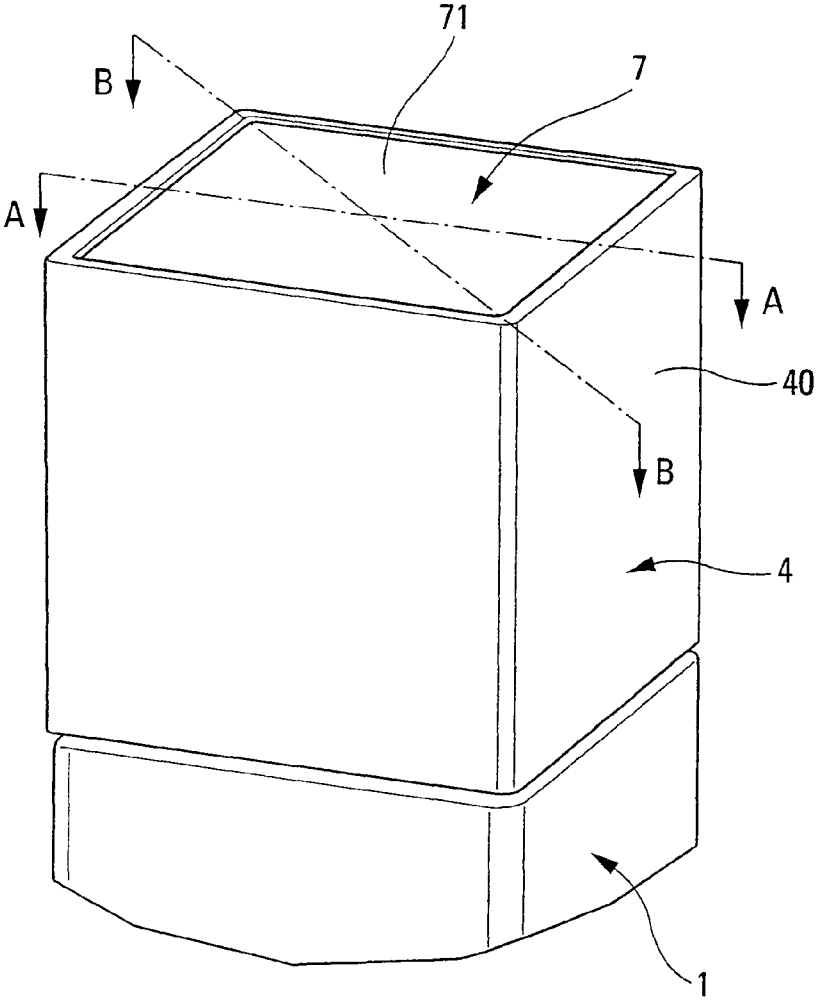
FIG. 2 is a view of the FIG. 1 dispenser head in the mounted state, and while in the low axial rest position.
Figure 5:
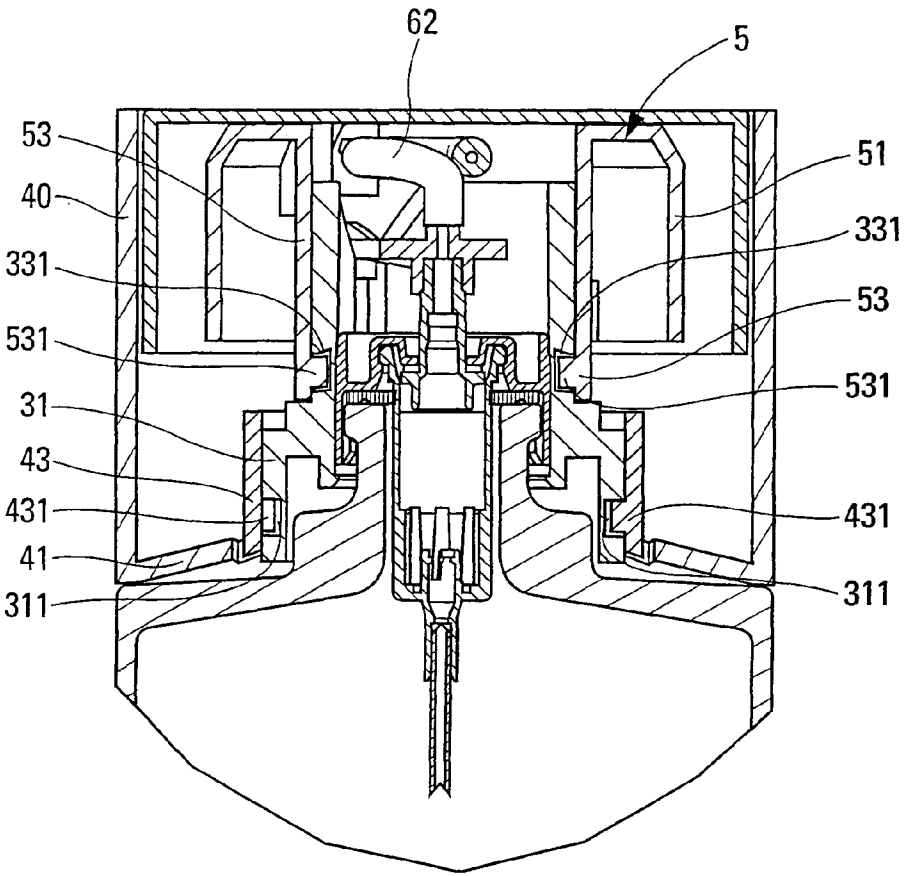
FIG. 5 is another section view on line B-B of FIG. 2.
Figure 4:
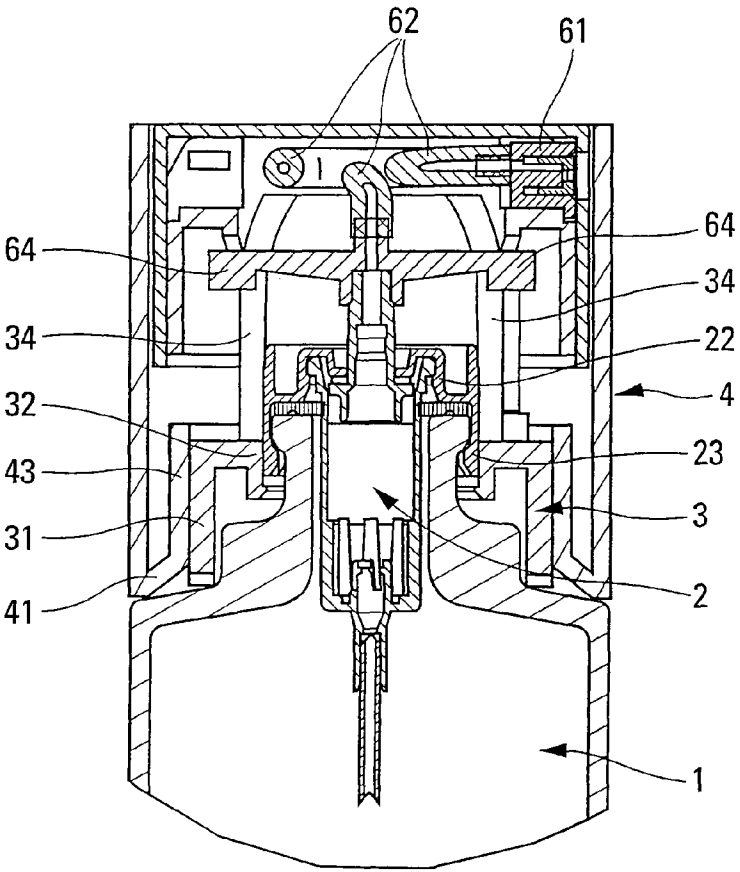
FIG. 4 is a vertical section view taken on section line A-A of FIG. 2.
Figure 6:
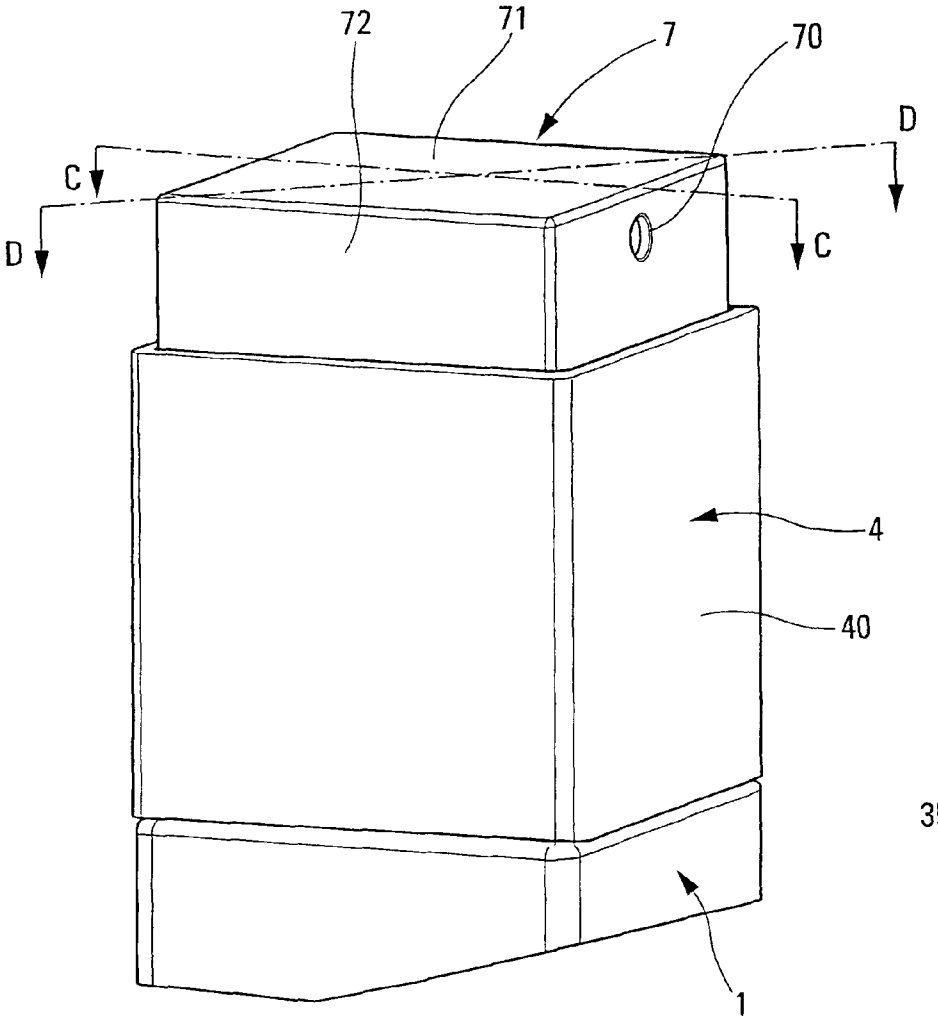
FIG. 6 is a view similar to FIG. 2 with the head in the high axial position.
Figure 9:
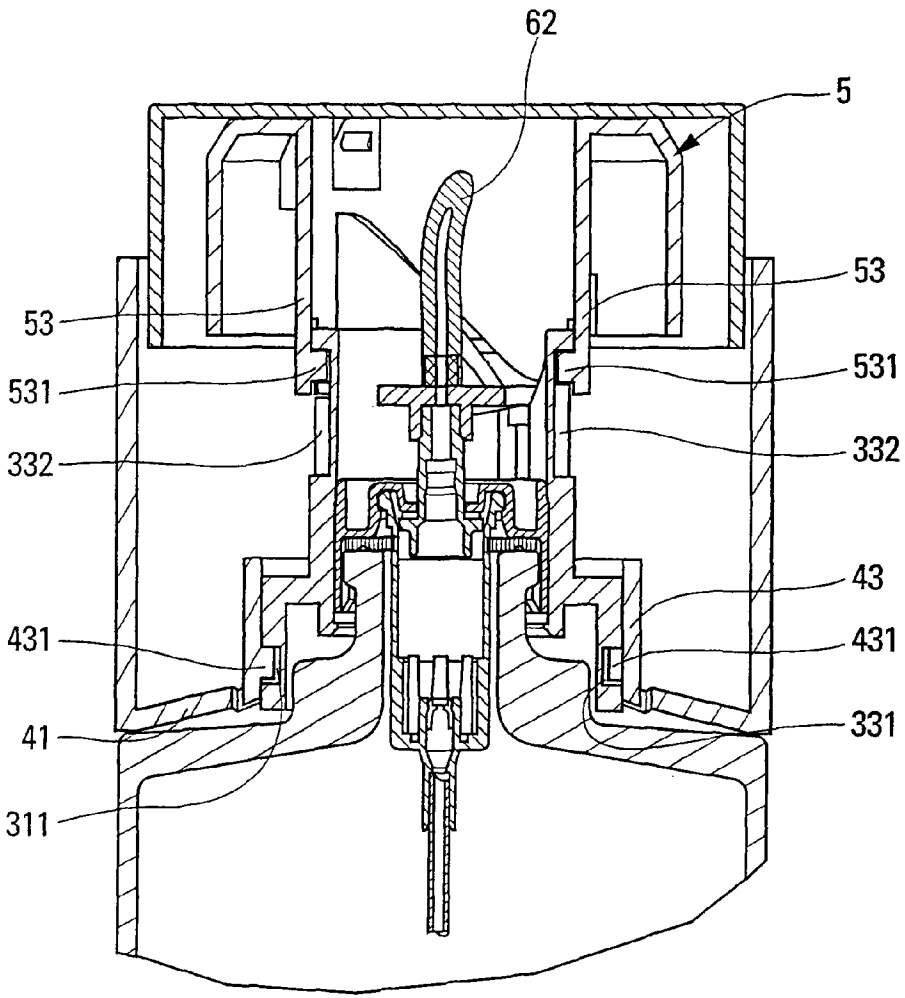
FIG. 9 is a vertical section view on section line D-D of FIG. 6.

It is specifically the actuator means 4 that co-operate with the base 31 of the hoop 3. To do this, the actuator means 4 define an internal cylinder 43 that surrounds the base 31 of the hoop 3. The cylinder is not visible in FIG. 1, but it can be seen in FIGS. 4 and 5. On its inside wall, the cylinder 43 defines two guide lugs 431 that become engaged in the guide grooves 311 formed by the base 31 of the hoop 3, as can be seen in FIG. 5. The lugs 431 can thus be displaced in their respective grooves 311 by turning the cylinder 43 about the base 31. The turning displacement of the cylinder relative to the base is limited by the lugs 431 coming into abutment against the ends of the grooves 311. The turning displacement of the cylinder relative to the base can be limited to 90°, for example. As a result of the completely horizontal orientation of the grooves 311, the cylinder 43 turns about the base 31 without any axial or vertical component. In order to cause the cylinder 43 to turn about the base 31 of the hoop 3, the actuator means 4 define an outer fairing 40, that, in this embodiment, is of cross-section that is polygonal, advantageously square. The fairing 40 is connected to the cylinder via an annular flange 41, such that the fairing surrounds the cylinder and together they act as a single piece. The dimensions of the fairing are preferably substantially identical to the dimensions of the body 10 of the reservoir, such that the fairing 40 can be placed in continuity with the body 10 of the reservoir, as can be seen in FIGS. 2 and 6. The bottom edge of the fairing 40 is advantageously situated in the proximity of, or in contact with, the reservoir. The fairing 40 constitutes handle means for actuating the internal cylinder 43. By turning the fairing 40 through 90°, it comes back into alignment with the reservoir 1. FIGS. 2 and 6 show the dispenser head with the fairing 40 turned to its two extreme positions that are both in alignment with the reservoir. In this embodiment, the fairing 40 is a cylinder of square section: however, the fairing 40 could be of some other shape, such as hexagonal, octagonal, or even circular, for example. The shape of the fairing 40 can be determined by the shape of the body 10 of the reservoir. However, it can be seen that it is advantageous to make the fairing 40 with a shape that is polygonal rather than with a circularly-cylindrical shape.

The pushbutton core 5 includes an outer casing 51 of general shape that is polygonal, advantageously square with rounded corners. The core 5 defines a central opening 52 that extends through the core. The central opening 52 is defined by an inner sleeve 53 that is for coming into engagement around the bushing 32 of the hoop 3. On its inside wall, the sleeve 53 defines two cam lugs 531 that are housed in the two cam paths 33 formed in the bushing 32 of the hoop 3. The core 5 is thus displaceable relative to the hoop 3 by moving the two cam lugs 531 along the two sinuous cam paths 33. At the helical portion 331, the core 5 is displaced helically both in turning and in translation, while at the axial vertical section 332, the core 5 is only displaced axially without any turning component. Engaging the core 5 on the bushing 32 is made easier by the presence of the guide slots 34 that impart a certain amount of elastic deformability to the bushing 32. In addition, the inner sleeve 53 also defines a force-transmission flange 56 that can be seen more clearly in FIG. 7. Its function is explained below with reference to the component element with which it interacts. The core 5 also defines a housing 55 for receiving a nozzle that forms the dispenser orifice, as can be seen below. The core 5 is engaged, at least in part, inside the fairing 40 of the actuator means 4. As a result of its co-operation with the cam paths 33 of the hoop 3, the core 5 is axially displaceable inside the fairing 40, in such a manner as to be capable of projecting upwards beyond the fairing.

Figure 3:
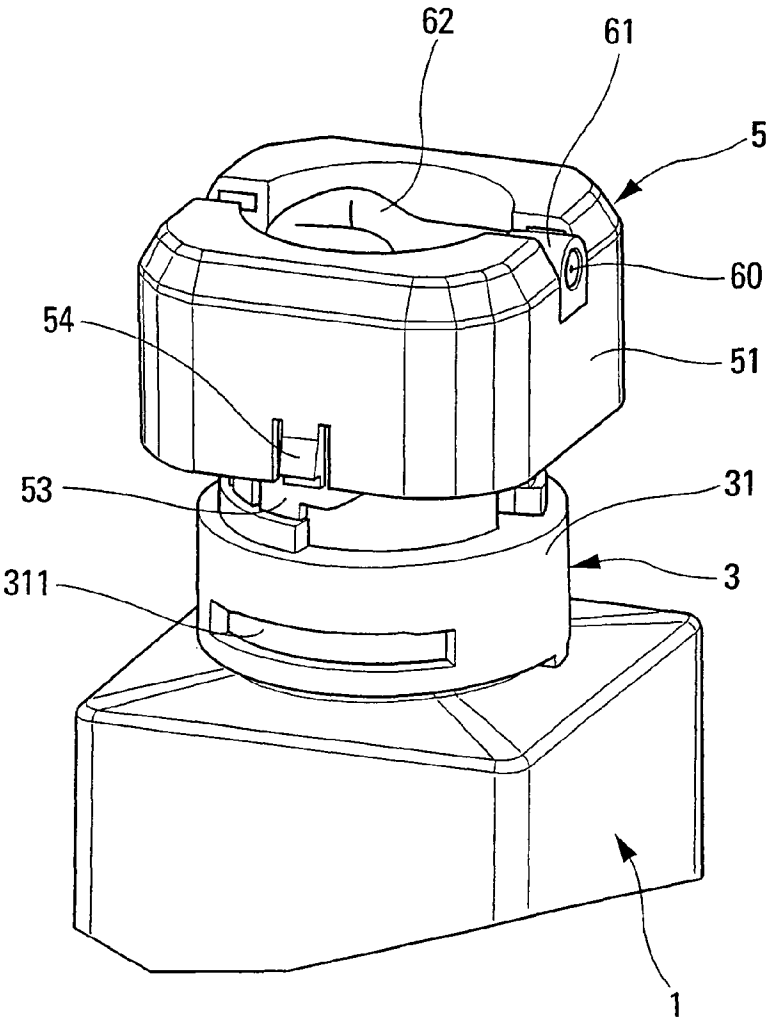
FIG. 3 is a view corresponding to FIG. 2 with some of the component elements of the head omitted in order to show the internal structure of the head.
Figure 7:
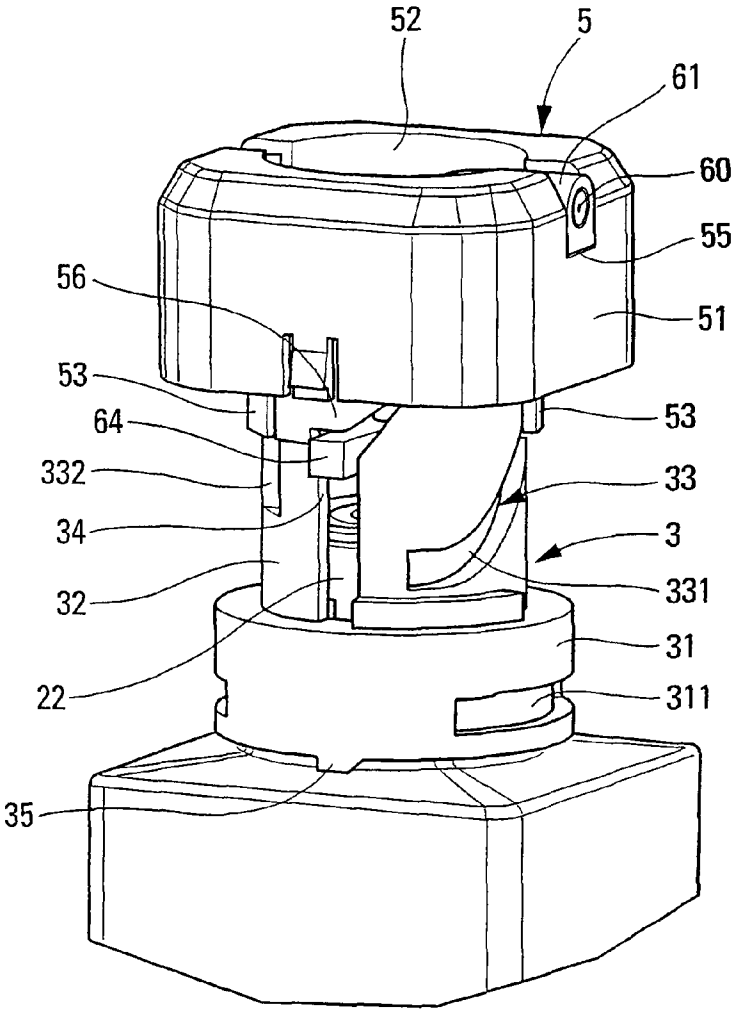
FIG. 7 is a view similar to FIG. 3 in the high axial position.

FIGS. 3 and 7 show the pushbutton core 5 in the low axial abutment position and in the high axial abutment position respectively. It can be seen that the core 5 is displaced axially relative to the hoop 3 and to the reservoir 1 by following the cam paths 33. In FIGS. 3 and 7, the core is shown stationary, and it is the hoop 3 and the reservoir 1 that have been turned through one fourth of a turn. In this embodiment, the actuator means are omitted for reasons of clarity, so as to be able to observe the displacement of the core 5 relative to the hoop 3.

Figure 8:
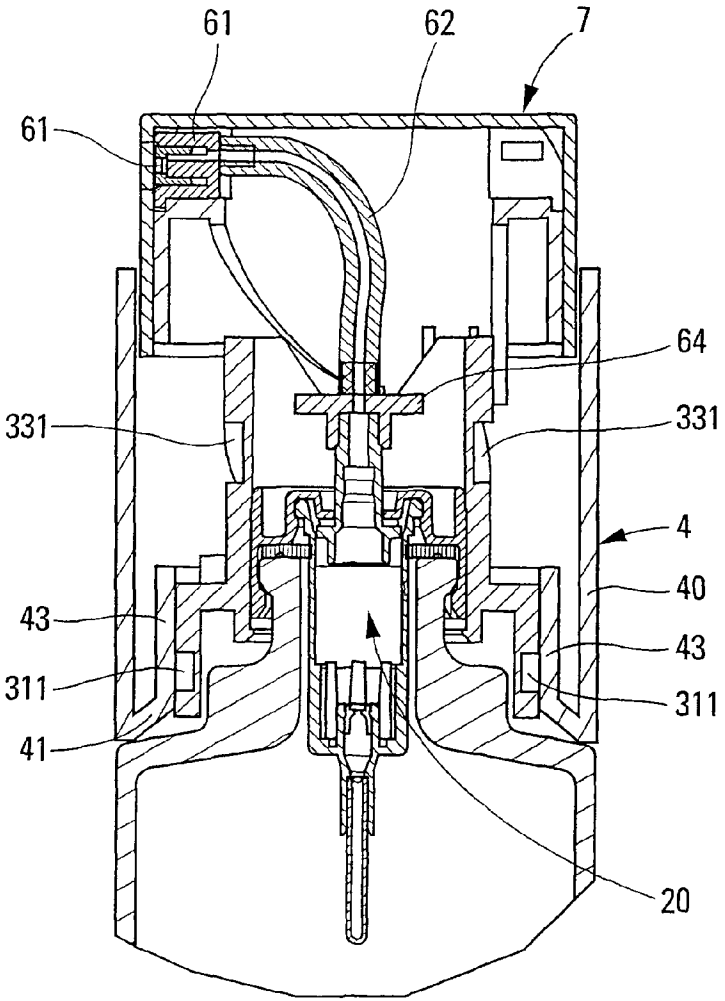
FIG. 8 is a vertical section view on section line C-C of FIG. 6.

The fluid-flow connection and thrust-transmission system 6 is a complex system comprising: a nozzle 61 defining a dispenser orifice 60; a flexible hose 62; a connection endpiece 63; and a force-transmission member 64. The nozzle 61 is for being housed in the housing 55 formed in the core 5, as can be seen very clearly in FIGS. 3 and 7. The connection endpiece 63 is for being interfitted on the free end of the actuator rod 21 of the dispenser member 2. This is visible in FIGS. 4, 5, 8, and 9. The flexible hose 62 thus makes it possible to connect the valve rod 21 to the dispenser orifice 60, while enabling the nozzle 61 to be displaced relative to the rod 21. It should be understood that the flexible hose 62 must be capable of being deformed when the core 5 is displaced from the low axial position (FIG. 3) to the high axial position (FIG. 7). The nozzle 61 is displaced not only axially relative to the rod 21, but it also turns about the rod 21. This leads to complex deformation of the flexible hose 62 between a position visible in FIG. 1 and another position visible in FIG. 8. In FIG. 1, the flexible hose 62 forms a bend, and then a loop, before reaching the nozzle 61. In FIG. 8, the flexible hose forms only a bend situated in a single plane. The flexible hose is a particularly advantageous element of the present invention since it enables a fluid-flow connection to be made between the valve rod 21 and the nozzle 61, while the pushbutton core 5 is displaced both in turning and in translation.

In this embodiment, the thrust-transmission member 64 is advantageously made integrally with the connection endpiece 63. It is even possible for the flexible hose 62 to be made integrally with the connection endpiece 63. The thrust-transmission member is constituted by two arms 64 that extend in diametrally-opposite manner relative to the connection endpiece 63. The two arms 64 are respectively engaged in the two slots 34 formed by the bushing 32 of the hoop 3, as can be seen very clearly in FIG. 7. The two arms 64 can thus be displaced axially in translation, but cannot turn at all as a result of the completely axial orientation of the slots 34. The function of the two arms 64 is to transmit the thrust force exerted by the core 5 to the valve rod 21. To do this, the core 5 comes to be positioned with its two thrust flanges 56 just above the ends of the arms 64 that project out from the respective slots 34, as can be seen in FIG. 7. In this position, it should easily be understood that a force exerted downwards on the core 5 would cause the two thrust-transmissions arms 64 to be displaced axially in their respective slots 34. The thrust flanges 56 only come into engagement with the arms 64 in the high axial position of the core 5, as shown in FIG. 7. In the low axial position shown in FIG. 3, the core 5 does not come into engagement with the arms 64, such that there is no coupling between the core 5 and the valve rod 21. In addition, in the low axial position, the core 5 cannot be displaced axially in translation because of the configuration of the cam paths 33.

Finally, the pushbutton cover 7 comes to cover the core 5, surrounding it at least in part. The core 5 and the cover 7 together form the pushbutton of the head. The cover 7 includes a thrust surface 71 on which the user can exert pressure by means of one or more fingers. In addition, the cover 7 includes a peripheral skirt 72, that, in this embodiment, is in the form of a polygonal cylindrical section. The skirt 72 becomes engaged around the casing 51 of the core 5 by means of a snap-fastener system 74, 54. The skirt 72 is dimensioned in such a manner that it is a sliding fit inside the fairing 4 of the actuator means 40. This is visible in FIGS. 2 and 6. The core 5 is therefore mounted in stationary manner inside the cover 7, which is itself engaged inside the fairing 40. Because of the polygonal shape of the fairing 40 and of the cover 7, turning the fairing 40 turns the cover 7, and consequently the core 5. However, the core 5 is engaged with the hoop 3 in the cam paths 33. As a result, turning the fairing 40 forces the cam lugs 531 of the core 5 to be moved along the respective cam paths 33 of the hoop 3. As a result, the core 5 and the cover 7 are displaced both in turning and in axial translation relative to the valve rod 21 that remains stationary relative to the body 20 and to the reservoir 1. With regard to the actuator means 4, they merely turn about the hoop 3, without any movement in translation. It should be kept in mind that the hoop 3 is mounted in completely stationary manner relative to the dispenser member and to the reservoir 1. The displacement of the core 5 and of the cover 7 is limited firstly by the extent of the grooves 311, and secondly by the extent of the cam paths 33. In a variant, the cam paths 33 alone could define the high and low axial abutment positions. In that event, the grooves 311 could extend over the entire periphery of the base 31, and serve solely as fastener means for the cylinder of the actuator means.

A principle of the invention resides in using a head covering element, such as the fairing 40, as actuator means in order to displace the pushbutton, constituted in this embodiment by the core 5 and by the cover 7, relative to the valve rod 21. Conventionally, the fairing 40 is a part that is mounted in stationary manner relative to the reservoir 10.

It should also be observed that the pushbutton is coupled to the actuator rod 21 only in the high axial position, which is the dispensing position. In the low axial position, the pushbutton is locked, since the cam path does not give it any axial freedom.

In its axial displacement relative to the fairing 40, the cover 7 is displaced between two extreme positions shown respectively in FIGS. 2 and 6. In the low axial position, the thrust surface 71 of the cover 7 is situated substantially in alignment with the top edge of the fairing 40. In contrast, in the high axial position shown in FIG. 6, the cover 7 projects upwards beyond the top edge of the fairing 40. It should also be observed that the dispenser orifice 60 is situated in a hole 70 formed in the skirt 72 of the cover 7. In the low axial position, the hole 70 is masked by the fairing 40. In the high axial position, the hole 70 is unmasked so as to allow fluid to be dispensed.

In order to guarantee that the head is properly oriented relative to the reservoir, it is possible to provide indexing means on the reservoir and on the hoop 3, so as to orientate the hoop 3 correctly relative to the reservoir. It is the hoop 3 that determines the angular orientation of the actuator means 4, and consequently of the pushbutton 5, 7. By way of example, the indexing means can be in the form of a projection 35 formed by the hoop 3, and that comes into abutment against a corresponding profile of the reservoir 1.

A circularly-cylindrical configuration of the actuator means 4 and of the pushbutton 5, 6 is also possible, but it is then necessary to provide means for constraining the actuator means and the pushbutton to turn together.

The invention claimed is:

1. A fluid dispenser head for mounting on a fluid reservoir (1), the head comprising:

a fluid dispenser member (2), comprising a body (20) that is mounted in stationary manner relative to the reservoir (1), and a valve rod (21) that is axially displaceable down and up;

a pushbutton (5, 7) that is axially displaceable down and up, driving the valve rod (21);

a dispenser orifice (60) that is connected to the valve rod; and actuator means (4) for driving the pushbutton in axial displacement relative to the valve rod (21), wherein the actuator means (4) cause the pushbutton (5, 7) to turn, with said pushbutton turning through an angular stroke, and displaced axially between a low axial position and a high axial position;

the dispenser head further comprising cam means for transforming the turning movement of the pushbutton into axial displacement of the pushbutton relative to the valve rod; and the actuator means turn without any axial displacement relative to the body, the cam means provided between the pushbutton and an element that is mounted in stationary manner relative to the body.

2. A dispenser head according to claim 1, including fastener means (22) for fastening the dispenser member (2) on the reservoir (1), the fastener means comprising a ring (22) that is engaged both with the dispenser member and with the reservoir, and a blocking hoop (34) for blocking the ring (22) on the reservoir (1), the actuator means (4) rotatably mounted on the hoop (3), the cam means (33, 53) formed between the pushbutton (5, 7) and the hoop (3).

3. A dispenser head according to claim 2, in which the pushbutton (5, 7) is housed inside the actuator means (4), the pushbutton and the actuator means presenting a section of shape that is polygonal, advantageously square.

4. A dispenser head according to claim 2, in which the member (64) is guided axially by the hoop (3).

5. A dispenser head according to claim 1, in which the pushbutton (5, 7) is axially displaceable, driving the valve rod (21) only in the high axial position.

6. A dispenser head according to claim 1, wherein the fluid dispenser member is a pump or a valve.

7. A fluid dispenser head for mounting on a fluid reservoir, the head comprising:

a fluid dispenser member, such as a pump or a valve, comprising a body (20) that is mounted in stationary manner relative to the reservoir, and a valve rod that is axially displaceable down and up;

a pushbutton that is axially displaceable down and up, driving the valve rod;

a dispenser orifice that is connected to the valve rod; and actuator means for driving the pushbutton in axial displacement relative to the valve rod, wherein the actuator means cause the pushbutton to turn, with said pushbutton turning through an angular stroke, and displaced axially between a low axial position and a high axial position; and the dispenser orifice (60) is mounted on the pushbutton, and is connected to the valve rod (21) via a flexible hose (62).

8. The fluid dispenser head according to claim 7, wherein the fluid dispenser member is a pump or a valve.

9. A fluid dispenser head for mounting on a fluid reservoir, the head comprising:

a fluid dispenser member, such as a pump or a valve, comprising a body that is mounted in stationary manner relative to the reservoir, and a valve rod that is axially displaceable down and up;

a pushbutton that is axially displaceable down and up, driving the valve rod;

a dispenser orifice that is connected to the valve rod; and actuator means for driving the pushbutton in axial displacement relative to the valve rod, wherein the actuator means cause the pushbutton to turn, with said pushbutton turning through an angular stroke, and displaced axially between a low axial position and a high axial position; and the dispenser orifice (60) is masked by the actuator means (4) when in the low axial position.

10. The fluid dispenser head according to claim 9, wherein the fluid dispenser member is a pump or a valve.

11. A fluid dispenser head for mounting on a fluid reservoir, the head comprising:

a fluid dispenser member, such as a pump or a valve, comprising a body that is mounted in stationary manner relative to the reservoir, and a valve rod that is axially displaceable down and up;

a pushbutton that is axially displaceable down and up, driving the valve rod;

a dispenser orifice that is connected to the valve rod; and actuator means for driving the pushbutton in axial displacement relative to the valve rod, wherein the actuator means cause the pushbutton to turn, with said pushbutton turning through an angular stroke, and displaced axially between a low axial position and a high axial position; and the valve rod (21) is provided with a force-transmission member (64), the pushbutton coming into engagement with said member (64) in the high axial position, and disengaged from said member (64) in the low axial position.

12. A dispenser head according to claim 11, in which the pushbutton includes two thrust flanges that become positioned on the member (64) in the high axial position, on either side of the valve rod.

13. A fluid dispenser head for mounting on a fluid reservoir, the head comprising:

a fluid dispenser member, comprising a body that is mounted in stationary manner relative to the reservoir, and a valve rod that is axially displaceable down and up;

a pushbutton that is axially displaceable down and up, driving the valve rod;

a dispenser orifice that is connected to the valve rod;

an actuator that drives the pushbutton in axial displacement relative to the valve rod, the actuator causes the pushbutton to turn, with said pushbutton turning through an angular stroke, and displaced axially between a low axial position and a high axial position; and a cam that transforms the turning movement of the pushbutton into axial displacement of the pushbutton relative to the valve rod; and the actuator turns without any axial displacement relative to the body, the cam provided between the pushbutton and an element that is mounted in stationary manner relative to the body.

14. A fluid dispenser head for mounting on a fluid reservoir, the head comprising:

a fluid dispenser member, comprising a body that is mounted in stationary manner relative to the reservoir, and a valve rod that is axially displaceable down and up;

a pushbutton that is axially displaceable down and up, driving the valve rod;

a dispenser orifice that is connected to the valve rod;

an actuator that drives the pushbutton in axial displacement relative to the valve rod, the actuator causes the pushbutton to turn, with said pushbutton turning through an angular stroke, and displaced axially between a low axial position and a high axial position; and the dispenser orifice is mounted on the pushbutton, and is connected to the valve rod via a flexible hose.

15. A fluid dispenser head for mounting on a fluid reservoir, the head comprising:

a fluid dispenser member, comprising a body that is mounted in stationary manner relative to the reservoir, and a valve rod that is axially displaceable down and up;

a pushbutton that is axially displaceable down and up, driving the valve rod;

a dispenser orifice that is connected to the valve rod;

an actuator that drives the pushbutton in axial displacement relative to the valve rod, the actuator causes the pushbutton to turn, with said pushbutton turning through an angular stroke, and displaced axially between a low axial position and a high axial position; and the dispenser orifice is masked by the actuator when in the low axial position.

16. A fluid dispenser head for mounting on a fluid reservoir, the head comprising:

a fluid dispenser member, comprising a body that is mounted in stationary manner relative to the reservoir, and a valve rod that is axially displaceable down and up;

a pushbutton that is axially displaceable down and up, driving the valve rod;

a dispenser orifice that is connected to the valve rod;

an actuator that drives the pushbutton in axial displacement relative to the valve rod, the actuator causes the pushbutton to turn, with said pushbutton turning through an angular stroke, and displaced axially between a low axial position and a high axial position; and the valve rod is provided with a force-transmission member, the pushbutton coming into engagement with said member in the high axial position, and disengaged from said member in the low axial position.

* * * * *